US005400060A

United States Patent [19]

Carlotta

[11] Patent Number: 5,400,060

[45] Date of Patent: Mar. 21, 1995

[54] THERMAL INK JET CARTRIDGE FACE SEALING FOR SHIPPING

[75] Inventor: Michael Carlotta, Sodus, N.Y.

[73] Assignee: Xerox Corporation, Stamford, Conn.

[21] Appl. No.: 904,114

[22] Filed: Jun. 25, 1992

[51] Int. Cl.[6] ..... B41J 2/165

[52] U.S. Cl. ..... 347/29; 347/87; 220/359

[58] Field of Search ..... 215/233; 220/359, 364; 222/441, 442; 346/1.1, 140 R; 229/123.1; 347/22, 29, 87

[56] References Cited

U.S. PATENT DOCUMENTS

| | | | |
|---|---|---|---|
| 3,883,060 | 5/1975 | Scarpa . | |
| 4,896,788 | 1/1990 | Bolte et al. | 220/359 |
| 4,977,003 | 12/1990 | Brown et al. | 220/359 |
| 4,986,859 | 1/1991 | Watanabe | 220/359 |
| 5,262,802 | 11/1993 | Karita et al. . | |

FOREIGN PATENT DOCUMENTS

| | | | |
|---|---|---|---|
| 0372728 | 6/1990 | European Pat. Off. . | |
| 0456840A1 | 11/1991 | European Pat. Off. . | |
| 2479775 | 10/1981 | France . | |
| 58-7362 | 1/1983 | Japan | 346/140 R |
| 58-65668 | 4/1983 | Japan | 346/140 R |
| 61-125851 | 6/1986 | Japan | 346/140 R |
| 63-21149 | 1/1988 | Japan | 346/140 R |
| 01-180351 | 7/1989 | Japan | 346/140 R |

*Primary Examiner*—Benjamin R. Fuller
*Assistant Examiner*—John Barlow
*Attorney, Agent, or Firm*—Oliff & Berridge

[57] ABSTRACT

A removable seal for the face of a printhead is a laminate tab made of a flexible, tear resistant material having a layer of low temperature melt material on one side thereof. The seal is molded to the face of the printhead by applying heat to the laminate tab to reflow the low temperature melt material onto the face of the printhead. The seal extends beyond at least one side of the face of the printhead to form an easily graspable, removable tab. The seal is used during shipping and handling to prevent ink from leaking from the printhead and to prevent contamination and damage of the nozzles.

14 Claims, 3 Drawing Sheets

THERMAL INK JET CARTRIDGE FACE SEALING FOR SHIPPING

BACKGROUND OF THE INVENTION

1. Field of the Invention

The present invention relates to a seal for a printhead and the process for producing the seal. More particularly, the invention relates to a removable seal molded to the face of a printhead for sealing the nozzles of the printhead during shipping and handling.

2. Description of Related Art

Thermal ink jet printing systems use thermal energy to produce a vapor bubble in an ink filled channel in a printhead that expels a droplet of ink onto a recording medium, such as paper. The thermal energy is selectively produced by resistors located in capillary-filled ink channels in the printhead near channel terminating nozzles or orifices in the face of the printhead to momentarily vaporize the ink and form bubbles on demand. Each temporary bubble expels an ink droplet and propels it towards a recording medium. The printing system may be incorporated in either a carriage-type printer or a pagewidth type printer. The carriage-type printer generally has a relatively small printhead containing the ink channels and nozzles. The printhead is usually sealingly attached to an ink manifold or to a cartridge assembly and is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. In contrast, the pagewidth printer has a stationary printhead having a length equal to or greater than the width of the paper. The paper is continuously moved past the pagewidth printhead in a direction normal to the printhead length and at a constant speed during the printing process.

Ink jet printing systems often experience several problems which adversely affect the quality and performance of printing. Among these problems are 1) evaporation of the volatile ink ingredients, including water; 2) clogging of the printhead nozzles caused by ink drying therein due to non-use for a period of time; 3) adherence of dust to the nozzle-containing face of the printhead due to the moisture of fluid ink around the nozzle; 4) leakage of ink from the nozzles; and 5) bubbles and dust taken into the printhead nozzles.

Shipping and handling prior to installation of a printhead often cause or at least aggravate the above-mentioned problems. A printhead will be jostled and tilted during shipment and installation, often causing ink to leak from the nozzles into the packaging thus wasting ink and resulting in additional time and effort in cleaning the printhead. Further, the nozzles can become clogged with dry ink or debris, and the ink channels can dry up and clog between the time the printhead is packaged for shipping and ultimately installed in a printer.

Therefore, manufacturers of printheads have attempted several techniques to seal the face of a printhead during shipping and handling. One such technique merely consists of applying tape or Mylar to the face of the printhead. However, these materials do not adhere well to the face of the printhead due to irregularities in the surface of the printhead die. Further, tape can leave adhesive residue on the face of the printhead which will later interfere with the printing operation. Another technique involves adhering tape onto the face of the printhead and then pressing a piece of plastic foam onto the tape. However, the foam cover requires additional space, cost and packaging. Also, the face of a thermal ink jet printhead may be uneven or irregular due to tolerances of the channel plate, heater plate, manifold and heat sink. The above materials do not easily accommodate such unevenness and therefore may leave gaps between the face of the printhead and the seal, resulting in leakage.

Thus, there is a need to provide an effective, yet easily removable, seal on the face of a printhead which is easy to manufacture and cost effective.

SUMMARY OF THE INVENTION

Accordingly, it is an object of the present invention to provide a seal on the face of the printhead which effectively prevents leakage of ink from within the printhead and prevents contamination of the nozzles from external sources.

Another object of the present invention is to provide a seal which accommodates an uneven surface of the face of the printhead.

A further object of the present invention is to provide a seal which is easily and quickly removed from the face of the printhead.

A further object of the present invention is to provide a seal which is easily and economically manufactured and applied to the face of the printhead.

The foregoing and other objects are attained by providing a seal for a printhead face comprising a laminate tab including a film having a layer of low-temperature melt material disposed on one side thereof for molding to the face of the printhead.

The foregoing objects are also attained by providing a printhead assembly comprising a printhead die with a face having nozzles therein and a seal removably secured to the face. The seal includes a laminate tab having a first layer and a second layer of low-temperature melt material coupled to the first layer, with the second layer being reflowed onto the face and covering the nozzles.

The foregoing objects are further obtained by a method of sealing the face of a printhead comprising thermally bonding a removable film laminate tab onto the face. The method of sealing the face of a printhead with a laminate tab includes using a tab with a low-melt material on one side thereof and comprises forming a breakaway tab in a web of laminate film and applying the low melt material side of the tab to the face of the printhead including breaking the tab from the web and molding the tab onto the face.

Other objects, advantages and salient features of the invention will become apparent from the following detailed description with, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE PREFERRED EMBODIMENTS

Figure 1:
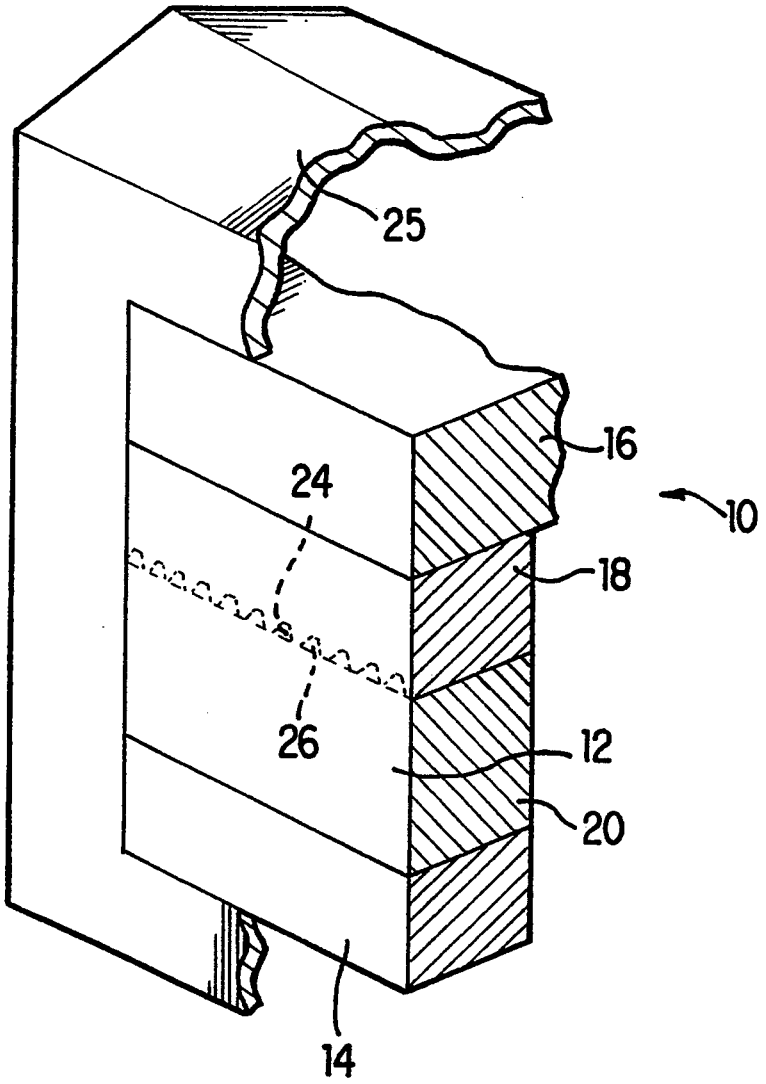
FIG. 1 is a partial perspective view of a printhead for use with the present invention.

As seen in FIG. 1, a printhead 10 includes a printhead die 12 coupled to a heat sink substrate 14. FIG. 1 represents a thermal ink jet cartridge type printhead which would typically be connected to an ink manifold 16 via an aperture (not shown).

Printhead die 12 includes a channel plate 18 coupled to a heater plate 20. The surface of heater plate 20, to which channel plate 18 is attached, has a plurality of resistive heater elements (not shown). The opposite surface of heater plate 20 is bonded to substrate 14. The surface of channel plate 18, positioned on heater plate 20, has grooves therein which define ink channels 24 that end in nozzles 26 in the front face of printhead die 12. Channel plate 18 and heater plate 20 are coupled together and a dicing action is performed to achieve coplanarity along the front face to produce nozzles 26. Ink channels 24 communicate with the aperture of manifold 16 in order to allow ink to flow from an ink manifold through ink channels 24 to nozzles 26. A front face of the printhead is surrounded by a face plate 25 which extends around the printhead components.

Figure 2:
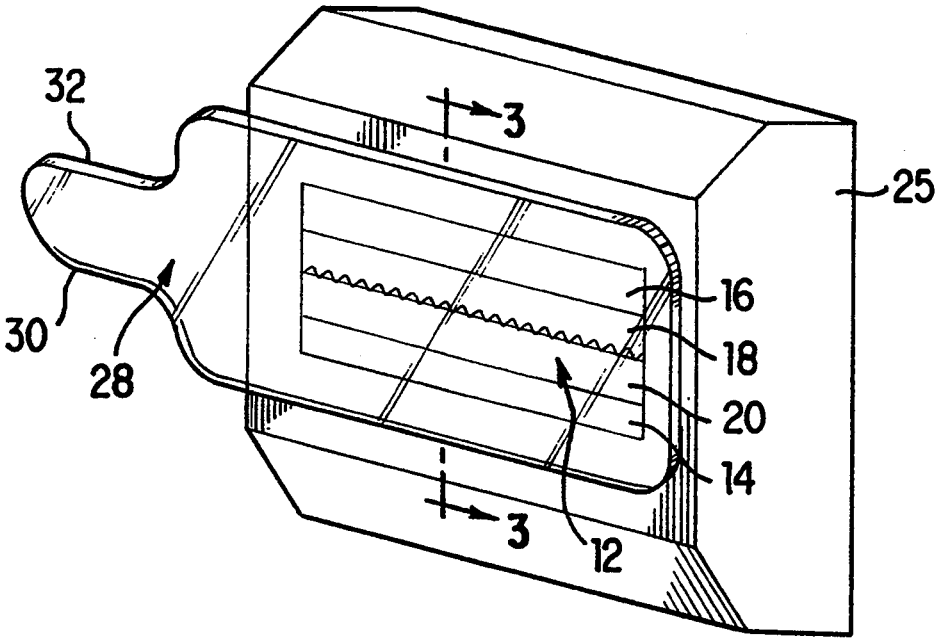
FIG. 2 is a perspective view of a front face of the printhead of FIG. 1 including a seal in accordance with the present invention.

As shown in FIG. 2, a seal 28 is secured to the front face of printhead die 12. Seal 28 is a thin film laminate comprising a layer of flexible, tear resistant film 30 and a layer of low-temperature melt material 32. Seal 28 is sized to fully cover nozzles 26 and extend beyond the face of printhead die 12 on at least one edge, thus forming a pull tab for easy removal. Preferably, seal 28 extends the printhead die 12 on all edges to partially cover face plate 25 (as shown). Low temperature melt material layer 32 is applied to the face of printhead die 12 and flexible, tear resistant film layer 30 forms the exterior side of seal 28.

Figure 3:
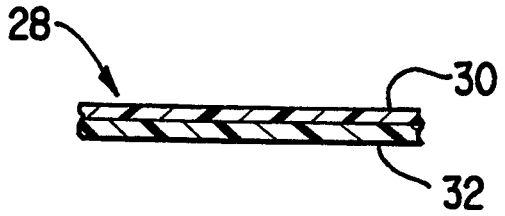
FIG. 3 is a partial side view in section of the seal of FIG. 2 taken along line 3—3.

Referring to FIG. 3, flexible, tear resistant film layer 30 is preferably made of a plastic material, such as polyester. Layer 30 has a higher melting temperature than layer 32. Any conventional flexible, tear resistant material could also be used, including fabric or paper. Low temperature melt material layer 32 is also preferably made of plastic but may consist of any easily meltable material. In the preferred embodiment, layer 32 is made of H. B. FULLER'S HM1580 FF16, which is a polyester-based hot melt glue which becomes flowable upon application of heat but seals upon cooling. Any material which will reflow onto the face of the printhead to provide a secure seal over nozzles 26 is suitable, even wax. Use of the flowable low-temperature melt material 32 does not have an adhesive residue and thus overcomes any problem associated with an adhesive residue remaining on the face of the printhead as in the prior art.

The process for applying the tab essentially includes initially flowing the melt material layer 32 for tacking the tab to the face of the printhead die in a position which covers the nozzles and preferably extends onto face plate 25 and then applying heat to the tab tacked onto the die to reflow the low-temperature melt material layer and thus mold the seal onto the printhead. It is not necessary to carefully align the tab on the face of the printhead since it is merely for sealing purposes and will be removed prior to use. Therefore, it is only necessary to ensure that the seal covers the nozzles.

Figure 4:
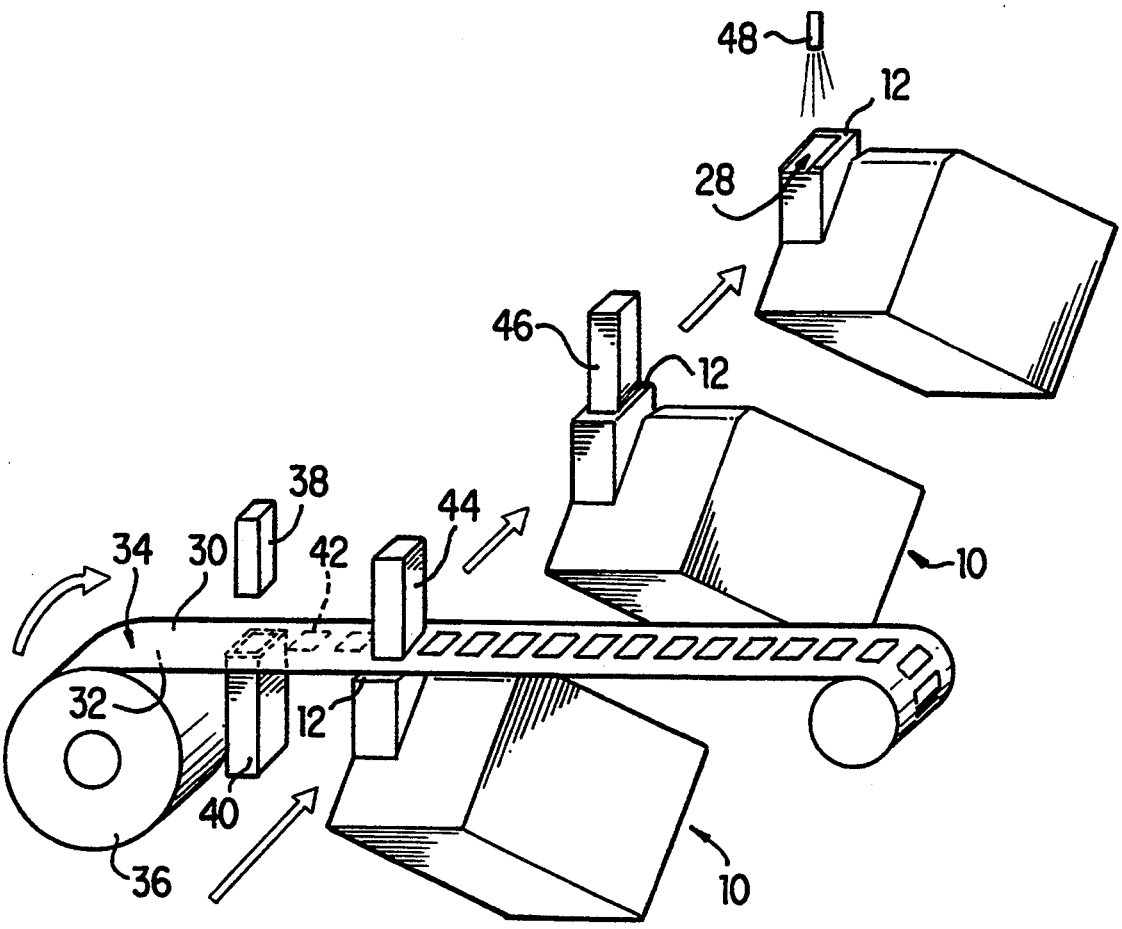
FIG. 4 is a schematic perspective view of a method for manufacturing the seal and applying the seal to the face of a printhead.

A method of manufacturing the seal is shown schematically in FIG. 4. In the process illustrated in FIG. 4, a web 34 of laminate material carried on a spool 36 comprises an upper layer of flexible, tear resistant film 30 and a lower layer of low melt material 32. Beginning at the lefthand side of FIG. 4, web 34 is drawn outwardly to a first work station where tab 28 is formed in web 34 by punch 38. Punch 38 comprises a support 40 located beneath web 34 and a conventional punching apparatus which forms breakaway tabs or a three- quarter depth punch to result in a frangible section 42 which can be easily broken from web 34 into tab 28.

Web 34 is then advanced to the second work station where frangible section 42 is broken from web 34 and applied to the face of printhead 10 by a pressure apparatus 44. Pressure apparatus 44 applies a light pressure to frangible section 42 to break tab 28 from web 34 and temporarily tack tab 28 to printhead 10. Pressure apparatus 44 can be any conventional device which is designed to apply a light uniform pressure, such as a metal block with a rubber pad in the form of a plunger. Alternatively, pressure apparatus 44 can comprise a heat applicator which would apply a low level of heat to frangible section 42 to break section 42 from web 34 and tack tab 28 onto printhead 10.

As shown in FIG. 4, once tab 28 is temporarily tacked onto printhead 10, printhead 10 is moved to a third work station where a short burst of heat is applied to tab 28 which is sufficient to reflow low melt material layer 32 of tab 28 onto the face of printhead 10. The third work station includes a heater 46 such as a heal: gun. Heater 46 applies a short burst of heat, for about 3 seconds for example, at a temperature of below about 400° F. in order to protect adjacent plastic materials from heat damage. Heater 46 is an aluminum block with a caloride heater and temperature sensor which supplies the short burst of heat at about 350° F. Reflowing of material 32 causes the seal to accommodate any uneven surfaces on the face of the printhead and causes material 32 to flow partially into ink channels 24 which keeps nozzles 26 clean and free of ink until installation. Heater 46 could also be replaced by a radiant heat apparatus, an ultrasonic device, a high pressure plunger or any apparatus which would cause material layer 32 to reflow.

It is also possible to combine the second and third work stations such that frangible section 42 of web 34 is removed and sealed in place by a heater such as 46 thus eliminating the step of temporarily tacking tab 28 to printhead 10 by pressure apparatus 44.

The final work station shown in FIG. 4 comprises a cooling station in which a blower 48 directs air onto tab 28 in order to solidify low melt material 32 and secure tab 28 in place. Blower 48 is optional since cooling can be accomplished by ambient air. Additionally, other types of conventional cooling apparatus such as a cold stamp or chiller could be used in place of blower 48.

Other methods of applying tab 28 to printhead 10 are also suitable. For example, tab 28 can be prepunched or cut and individually applied to the face of printhead 10. Tab 28 could also be applied using a bowl fed process or other types of conventional assembly line processes. Tabs 28 could even be applied by hand. The application of tabs 28 are especially applicable to thermal ink jet technology using side shooting where heater plate 20 is matched with channel plate 18 and diced, at which time tab 28 could be immediately applied to printhead die 12.

Thus, it is seen that any method of applying tab 28 to face of printhead 10 is suitable. It is evident that placement of seal 28 does not require precise manufacturing processes and therefore can be inexpensively executed. Although the present invention has been described with respect to a thermal ink jet cartridge type printhead, the seal in accordance with the present invention can be applied to any type of printhead having nozzles in the face thereof, including a page width printhead or a staggered array printhead. Individual seals or one large seal could be used in such situations. The seal in accordance with the, present invention could also be used in piezoelectric printing assemblies or any printing assembly in which it is desirable to seal the printing nozzles prior to installation.

While advantageous embodiments have been chosen to illustrate the invention, it would be understood by those skilled in the art that various changes and modifications can be made therein without departing from the scope of the invention as defined in the appended claims.

What is claimed is:

1. A method of sealing a face of a printhead containing a plurality of ink nozzles with a laminated tab having a first layer of a flexible material and a second layer of a low temperature melt material capable of flowing upon application of heat at 400° F. (205° C.) or less, the first layer being resistant to flowing at said heat, comprising the steps of:

forming the laminated tab from a laminate web by joining the second layer to the first layer;

applying the second layer of the tab onto the nozzle face of the printhead so that at least one end of the tab extends beyond the face, wherein said second layer initially flows upon application to tack the second layer to said face;

applying heat of less than 400° F. (205° C.) to said tab to reflow said second layer onto said face and into each of said plurality of nozzles within said face; and cooling said tab to resolidify said second layer and to cause said second layer to be non-flowable, wherein the cooling of said tab bonds said second layer to said face and individually seals each of said plurality of nozzles from external contamination or leakage of ink.

2. The method of claim 1, further comprising the step of removing said tab from said face and from within each of said plurality of nozzles without leaving any residue in said nozzles or on said face.

3. The method of claim 2, wherein said step of removing also removes any existing dust from said nozzles and said face by causing the dust to become attached to and removed with said tab.

4. The method of claim 1, wherein said step of forming a laminated tab includes forming a laminated web consisting of said first layer and said second layer and subsequently punching a breakaway tab from said web.

5. The method of claim 4, wherein said second layer of said breakaway tab is subsequently applied to said face and heated.

6. The method of claim 1, wherein the tab is heated to a temperature of about 350° F.

7. The method of claim 1, further comprising temporarily tacking the tab onto the face prior to molding. tacking the tab onto the face prior to molding.

8. A printhead assembly comprising:

a printhead die with a face having nozzles in communication with an ink source therein; and a seal removably secured to said face including a laminate tab having a first layer and a second layer, said second layer being of low temperature melt material coupled to said first layer, said second layer covering all of said nozzles and being reflowed onto said face through application of heat at a temperature of less than 400° F. (205° C.) causing said second layer to flow over said face, covering any surface irregularities and extending at least partially into each of said nozzles, said second layer solidifying upon cooling to effectively seal each of said nozzles and said face from contamination and prevent leakage of ink onto said face from said nozzles.

9. The printhead assembly of claim 8, wherein said first layer is a flexible, tear-resistant film.

10. The printhead assembly of claim 8, wherein said first layer is polyester.

11. The printhead assembly of claim 8, wherein said first layer has a higher melting point than said second layer.

12. The printhead assembly of claim 8, wherein said second layer is plastic.

13. The printhead of claim 8, wherein said second layer is a polyester hot melt glue.

14. The printhead assembly of claim 1, wherein said seal extends beyond said face on at least one edge.

* * * * *